US010068720B2

(12) United States Patent
Betances Sansur et al.

(10) Patent No.: US 10,068,720 B2
(45) Date of Patent: Sep. 4, 2018

(54) ELECTRICAL SYSTEM, AND ELECTRICAL SWITCHING APPARATUS AND GUARD MEMBER THEREFOR

(71) Applicant: EATON CORPORATION, Cleveland, OH (US)

(72) Inventors: Luis Enrique Betances Sansur, Santo Domingo (DO); Sandy Omar Jimenez Gonzalez, Monaca, PA (US); James Gerard Maloney, Industry, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 170 days.

(21) Appl. No.: 15/152,661

(22) Filed: May 12, 2016

(65) Prior Publication Data

US 2017/0330701 A1 Nov. 16, 2017

(51) Int. Cl.
*H01H 9/02* (2006.01)
*H01H 71/02* (2006.01)

(52) U.S. Cl.
CPC ..... *H01H 9/0264* (2013.01); *H01H 71/02* (2013.01)

(58) Field of Classification Search
CPC ..... H01H 21/04; H01H 23/04; H01H 71/02; H01H 9/0264
See application file for complete search history.

(56) References Cited

U.S. PATENT DOCUMENTS

| | | | | |
|---|---|---|---|---|
| 3,213,254 | A * | 10/1965 | Strom | H01B 3/30 174/140 R |
| 5,150,091 | A | 9/1992 | Hart et al. | |
| 5,493,092 | A | 2/1996 | Rowe | |
| 5,933,066 | A | 8/1999 | Chontas et al. | |
| 6,144,001 | A * | 11/2000 | Green | H01H 9/0264 200/304 |
| 6,356,175 | B1 * | 3/2002 | DeGrazia | H01H 9/0264 335/132 |
| 7,182,626 | B2 * | 2/2007 | Langolf | H01R 13/506 439/473 |
| 7,798,868 | B2 * | 9/2010 | Borona | H01R 4/305 335/202 |
| 9,548,170 | B2 * | 1/2017 | Crooks | H01H 9/0264 |
| 2014/0151201 | A1 | 6/2014 | Sisley et al. | |

* cited by examiner

*Primary Examiner* — Felix O Figueroa
(74) *Attorney, Agent, or Firm* — Eckert Seamans

(57) ABSTRACT

A guard member is for an electrical switching apparatus of an electrical system. The electrical system includes at least one electrical conductor. The electrical switching apparatus is structured to move from a CLOSED position to an OPEN position in response to a trip condition. The electrical switching apparatus has a terminal end coupled to the electrical conductor. The guard member includes a body having a receiving portion structured to receive the electrical conductor, and a coupling portion extending from the receiving portion and being structured to be coupled to the terminal end. The coupling portion has a number of thru holes in order to dissipate heat generated by the electrical switching apparatus moving from the CLOSED position to the OPEN position.

4 Claims, 8 Drawing Sheets

ELECTRICAL SYSTEM, AND ELECTRICAL SWITCHING APPARATUS AND GUARD MEMBER THEREFOR

BACKGROUND

Field

The disclosed concept relates to electrical systems. The disclosed concept further relates to electrical switching apparatus, such as, for example, circuit breakers for electrical systems. The disclosed concept also relates to guard members for electrical switching apparatus.

Background Information

Electrical apparatus, such as electrical switching apparatus, are used to protect electrical circuitry from damage due to a trip condition, such as, for example, an overcurrent condition, an overload condition, an undervoltage condition, a relatively high level short circuit or fault condition, a ground fault or arc fault condition. Circuit breakers, for example, commonly include wiring terminals as a means to attach electrical conductors (e.g., without limitation, wires or cables). While the wires are generally insulated, the end that attaches to the circuit breaker wiring terminal has the insulation removed (i.e., stripped).

It is common that the stripped portion of these wires extends to some degree outside the circuit breaker wiring terminal, such that, when a person is exposed to the circuit breaker and associated wiring, the person is also exposed to some portion of the uninsulated wires, and possibly also the uninsulated portion of the circuit breaker wiring terminal. This exposure to uninsulated electrically energized conductors (wires and/or wiring terminals) allows for the possibility of inadvertent contact by a person, tool, or the like, while performing various types of service or maintenance activities. Additionally, in order to be properly certified, for example and without limitation, by Underwriters Laboratories Inc. (UL), headquartered in Northbrook, Ill., some circuit breakers are required to have no live components accessible when the circuit breaker is turned off.

There is, therefore, room for improvement in electrical systems, and in electrical switching apparatus and guard members therefor.

SUMMARY

These needs and others are met by embodiments of the disclosed concept, which are directed to an electrical system, and electrical switching apparatus and guard member therefor.

As one aspect of the disclosed concept, a guard member for an electrical switching apparatus of an electrical system is provided. The electrical system includes at least one electrical conductor. The electrical switching apparatus is structured to move from a CLOSED position to an OPEN position in response to a trip condition. The electrical switching apparatus has at least one terminal end coupled to the electrical conductor. The guard member includes a body having a receiving portion structured to receive the electrical conductor, and a coupling portion extending from the receiving portion and being structured to be coupled to the terminal end. The coupling portion has a number of thru holes in order to dissipate heat generated by the electrical switching apparatus moving from the CLOSED position to the OPEN position.

As another aspect of the disclosed concept, an electrical switching apparatus including the aforementioned guard member is provided.

As another aspect of the disclosed concept, an electrical system including the aforementioned electrical switching apparatus is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the term "coupling member" refers to any suitable connecting or tightening mechanism expressly including, but not limited to, zip ties, wire ties, rivets, screws, bolts, the combination of bolts and nuts (e.g., without limitation, lock nuts), and washers and nuts.

As employed herein, the term "electrical conductor" refers to any suitable electrically conductive element, expressly including, but not being limited to, cables or wires.

A number of non-limiting example embodiments of the disclosed concept will be described in greater detail below for purposes of illustrating the disclosed concept. In particular, a number of non-limiting EXAMPLES of novel guard members 130,190,230,290,295,230',290',295',430, 530,630,630' provide protection for operators against inadvertent contact with live electrical components of associated electrical systems, allow for heat within the electrical systems to be dissipated, and many provide a mechanism for exhaustive gases to be vented from the electrical systems. It will be appreciated that the following EXAMPLES are provided solely for purposes of illustration and are not to be deemed to be exclusive or to otherwise limit the scope of the disclosed concept in any way.

EXAMPLE 1

Figure 1:
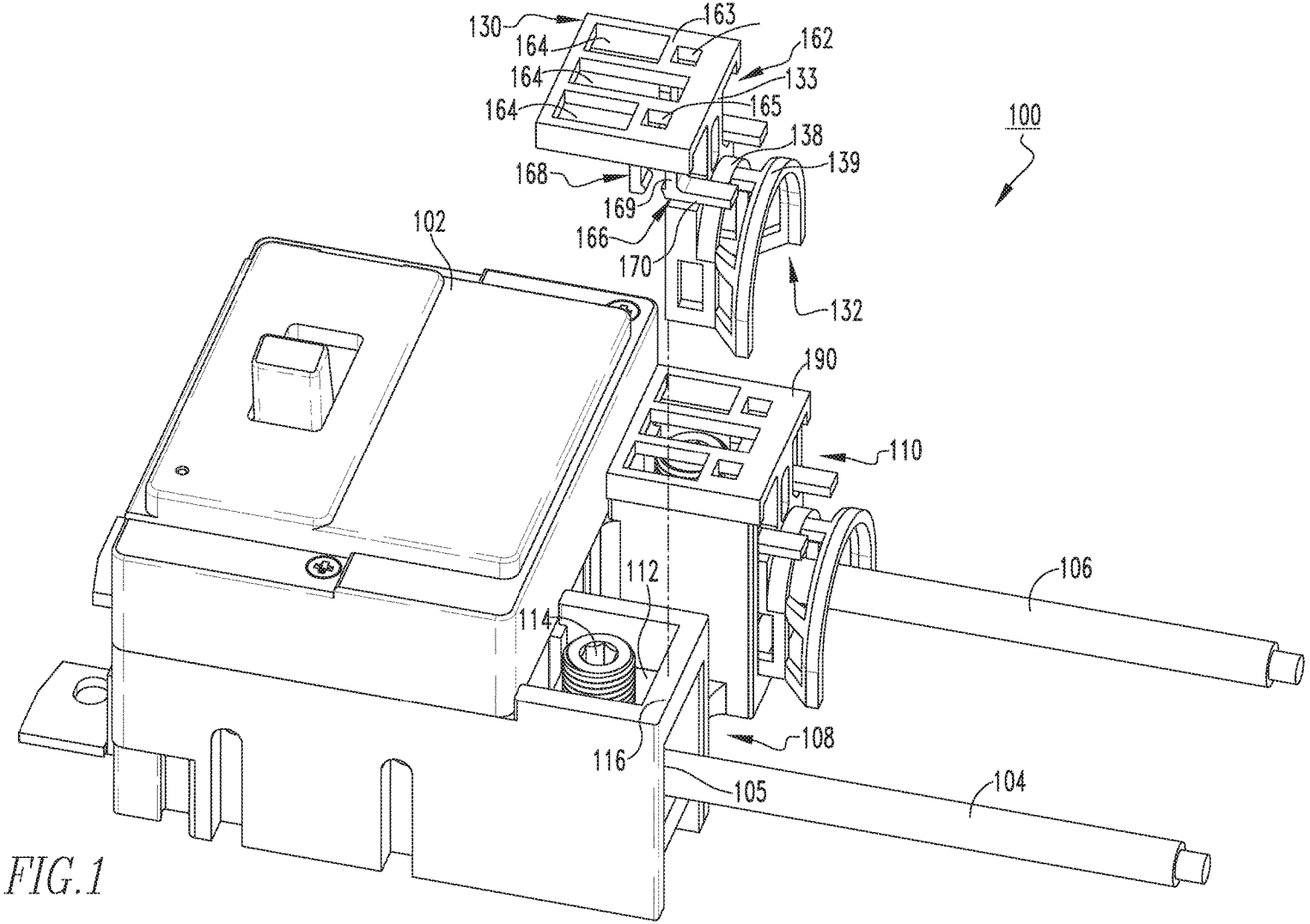
FIG. 1 is a partially exploded front isometric view of an electrical system, and electrical switching apparatus and guard member therefor, in accordance with a non-limiting embodiment of the disclosed concept.

FIG. 1 shows an electrical system 100, in accordance with a non-limiting embodiment of the disclosed concept. The example electrical system 100 includes an electrical switching apparatus (e.g., without limitation, circuit breaker 102) and a number of electrical conductors (two example wires 104,106 are shown) mechanically coupled and electrically connected to the circuit breaker 2. The circuit breaker 102 moves from a CLOSED position to an OPEN position in response to a trip condition in a generally well known manner. The circuit breaker 102 also includes a number of novel guard members 130,190 that protect operators against unintended and potentially dangerous contact with live energized components of the electrical system 100, as will be discussed in greater detail below.

Furthermore, the example circuit breaker 102 includes a number of terminal ends 108,110. Although the electrical system 100 includes two wires 104,106 for the two terminal ends 108,110 and two corresponding guard members 130, 190, only the wire 104, the terminal end 108, and the guard member 130 will be described in greater detail herein for purposes of economy of disclosure. It will be appreciated that the wire 106, the terminal end 110 and the guard member 190 operate in substantially the same manner as the wire 104, the terminal end 108, and the guard member 130. The terminal end 108 has a collar member 112, a terminal screw 114 coupled to the collar member 112, and a housing portion 116 coupled to the collar member 112. Additionally, the wire 104 has a distal end portion 105 that engages the collar member 112 and the terminal screw 114 in a generally well known manner. In prior art electrical systems (not shown), when electricity is flowing, the energized terminal screw, collar member, and exposed portions of the wire present dangers to operators. More specifically, in the prior art electrical systems (not shown), there is often no barrier between operators and these energized components. In accordance with the disclosed concept, the guard members 130,190 provide such a barrier for the electrical system 100, and further allow for heat to be dissipated near the terminal ends 108,110.

Figure 2:
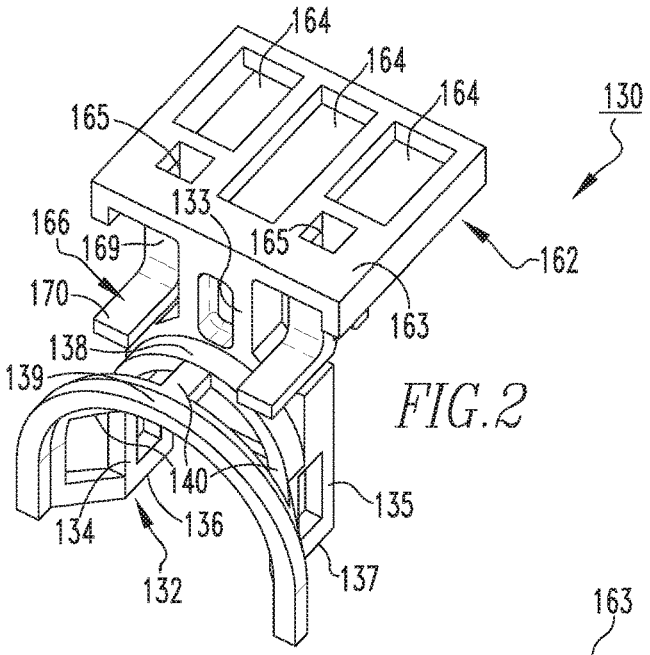
FIGS. 2, 3, and 4 are isometric, side elevation, and front elevation views, respectively, of a guard member for the electrical system of FIG. 1.

Referring to FIG. 2, the guard member 130 includes a body having a receiving portion 132 that receives the wire 104 (FIG. 1), and a coupling portion 162 extending from the receiving portion 132. The coupling portion 162 is coupled to the housing portion 116 and allows the guard member 130 to be reliably and securely retained on the circuit breaker 102 in the desired predetermined position. The coupling portion 162 includes a generally planar wall portion 163 having a number of thru holes (see, for example, elongated slots 164 and holes 165) that allow for heat dissipation as well as venting of exhaustive gases given off during circuit interruption. The guard members 130,190 are made of suitable insulative materials (e.g., without limitation, a flexible rubber material). In this manner, when coupled to the terminal end 108, the wall portion 163 of the guard member 130 overlays the distal end portion 105 of the wire 104, the collar member 112, and the terminal screw 114 in order to provide a protective barrier against inadvertent contact with these components.

Additionally, the slots 164 and the holes 165 advantageously allow for heat to be dissipated as well as for exhaustive gases to be reliably vented when the circuit breaker 102 moves from the CLOSED position to the OPEN position. As such, in addition to protecting operators from inadvertent contact with energized components, the guard member 130 prevents undesirable heat buildup in the circuit breaker 102 and allows for gases to be reliably vented. Prior art circuit breakers (not shown) attempting to provide a barrier against such inadvertent contact, by way of contrast, do not provide such heat dissipation and venting means. For example, known guard members (not shown) are often closed structures (e.g., devoid of thru holes) such that they do not allow heat and exhaustive gases to escape, thereby creating undesirable pressure buildups that cause the guard members to be forcibly ejected (e.g., blown off) from the circuit breaker during an interruption. Accordingly, among other benefits, the guard member 130 overcomes these drawbacks by virtue of the configuration of the slots 164 and the holes 165.

Figure 3:
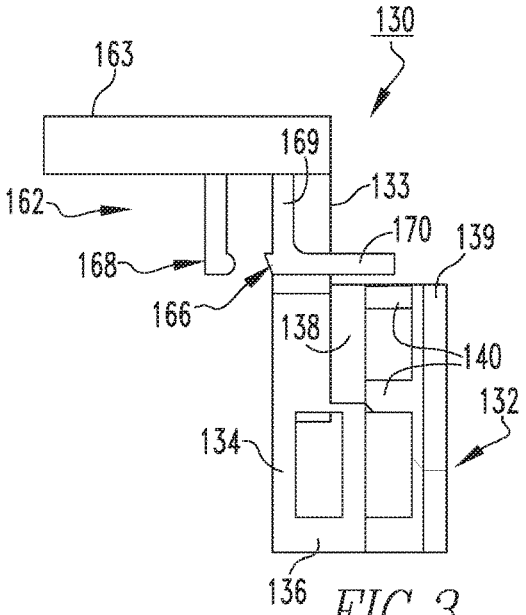

As shown in FIG. 3, the coupling portion 162 further includes a pair of flexible arms 166,168 extending from the wall portion 163 The first flexible arm 166 includes an extension portion 169 and a tab portion 170 extending from the extension portion 169 away from the second flexible arm 168 and being perpendicular to the second flexible arm 168. The extension portion 169 and the second flexible arm 168 are generally parallel to one another and are structured to be located on opposing sides of the housing portion 116 (FIG. 1) in order to couple the guard member 130 to the housing portion 116 by a snap-fit mechanism. Furthermore, the tab portion 170 provides a convenient grasping mechanism for the guard member 130 to be coupled to and removed from the housing portion 116. That is, an operator can use the tab portion 170 as a lever to rotate the second flexible arm 168 away from and toward the first flexible arm 166 to allow the guard member 130 to be coupled to and/or removed from the housing portion 116. It will be appreciated with reference to FIG. 4 that the example guard member 130 includes a second pair of flexible arms (shown but not indicated) extending from the wall portion 163, and being configured the same as and structured to be coupled to the housing portion 116 in substantially the same manner as the flexible arms 166,168. Although the instant exemplary embodiment has been described herein in association with the flexible arms 166,168 being employed to couple the guard member 130 to the housing portion 116, it will be appreciated that other suitable alternative configurations and/or geometries of arms (not shown) may be employed in order to perform the desired coupling function.

Additionally, the receiving portion 132 likewise provides a barrier between operators and potentially energized components of the electrical system 100. Referring again to FIG. 2, the receiving portion 132 includes a base portion 133 extending from and being perpendicular to the wall portion 163. The base portion 133 has side portions 134,135 that have respective end portions 136,137 that are spaced apart from one another and are located opposite the wall portion 163. The base portion 133 also has a first barrier portion 138 extending from the first side portion 134 to the second side portion 135, a second barrier portion 139 spaced from the first barrier portion 138, and a number of connecting portions 140 each extending from the second barrier portion 139 to at least one of the first side portion 134, the second side portion 135, and the first barrier portion 138. As shown, the connecting portions 140 are each spaced from one another and are thus oriented such that elongated slots are formed between the barrier portions 138,139. In this manner, the receiving portion 132, like the coupling portion 162, is advantageously configured to provide advantages in terms of allowing heat to be dissipated from the circuit breaker 102 as well as allowing exhaustive gases to be vented.

Figure 4:
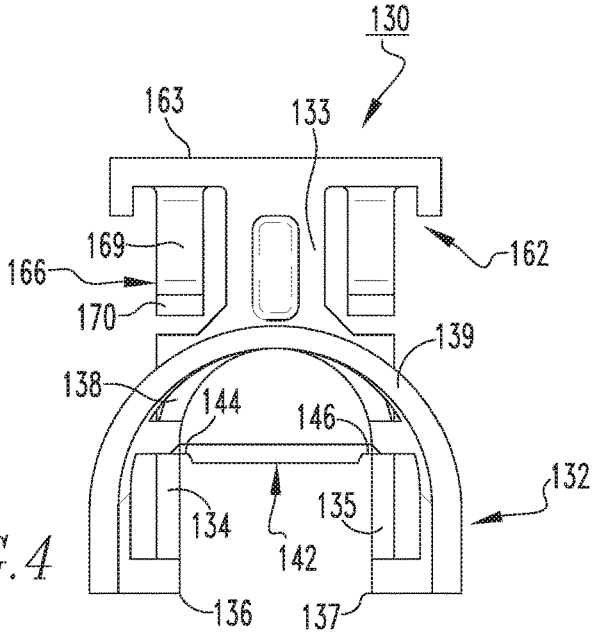

It will be appreciated with reference to FIG. 4 that the barrier portions 138,139 are each structured to be concave facing the wire 104 (FIG. 1). Continuing to refer to FIG. 4, the receiving portion 132 further includes a support portion 142 extending from the first side portion 134 to the second side portion 135. The support portion 142 has a first thinned portion 144 extending from the first side portion 134 and a second thinned portion 146 extending from the second side portion 135. By including the support portion 142, the guard member 130 is advantageously able to be employed with relatively small wires (i.e., in terms of diameter) as well as relatively large wires. More specifically, with a relatively small wire, the support portion 142 provides a structure for the wire to be secured against. With a relatively large wire, the thinned portions 144,146 allow the support portion 142 to be easily separated (i.e., torn off) from the side portions 134,135 to allow the wire to be secured against, for example, the barrier portions 138,139.

Furthermore, in addition to providing the aforementioned advantages, the guard members 130,190 advantageously allow the circuit breaker 102 to pass certification requirements by Underwriters Laboratories Inc. (UL), headquartered in Northbrook, Ill.

EXAMPLE 2

Figure 5:
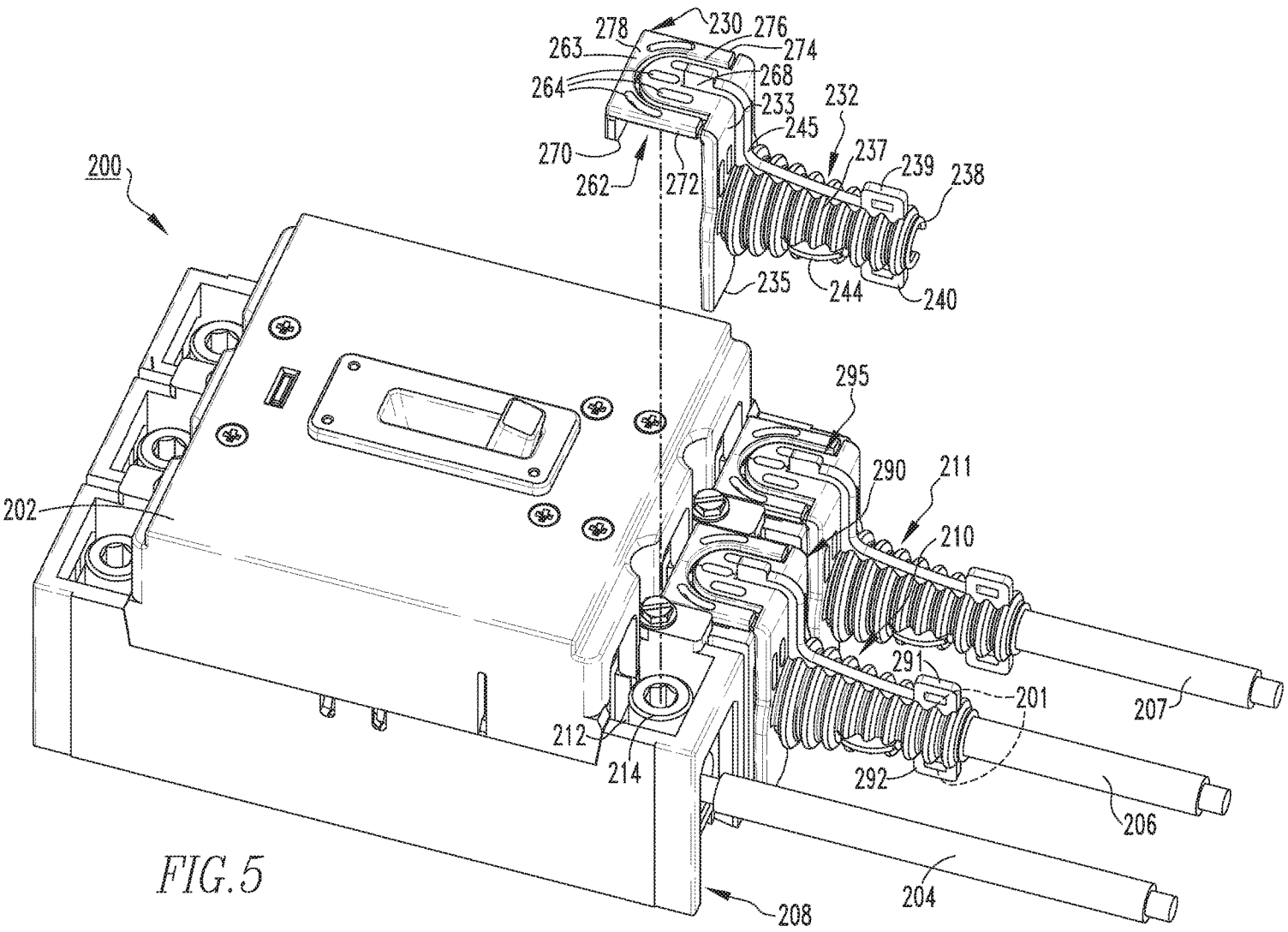
FIG. 5 is a partially exploded isometric view of an electrical system, and electrical switching apparatus and guard member therefor, in accordance with another non-limiting embodiment of the disclosed concept.

FIG. 5 shows another example electrical system 200. The wires 204,206,207 mechanically couple and electrically connect to the corresponding terminal ends 208,210,211 in the same manner as the wires 104,106 and the terminal ends 108,110, discussed above. The example novel guard members 230,290,295 provide an alternative mechanism from the guard members 130,190 to protect operators and dissipate heat from the electrical system 200. The guard member 230 will be substantially discussed in greater detail herein, although it will be appreciated that the guard members 290,295 are structured and function the same as the guard member 230.

Figure 6:
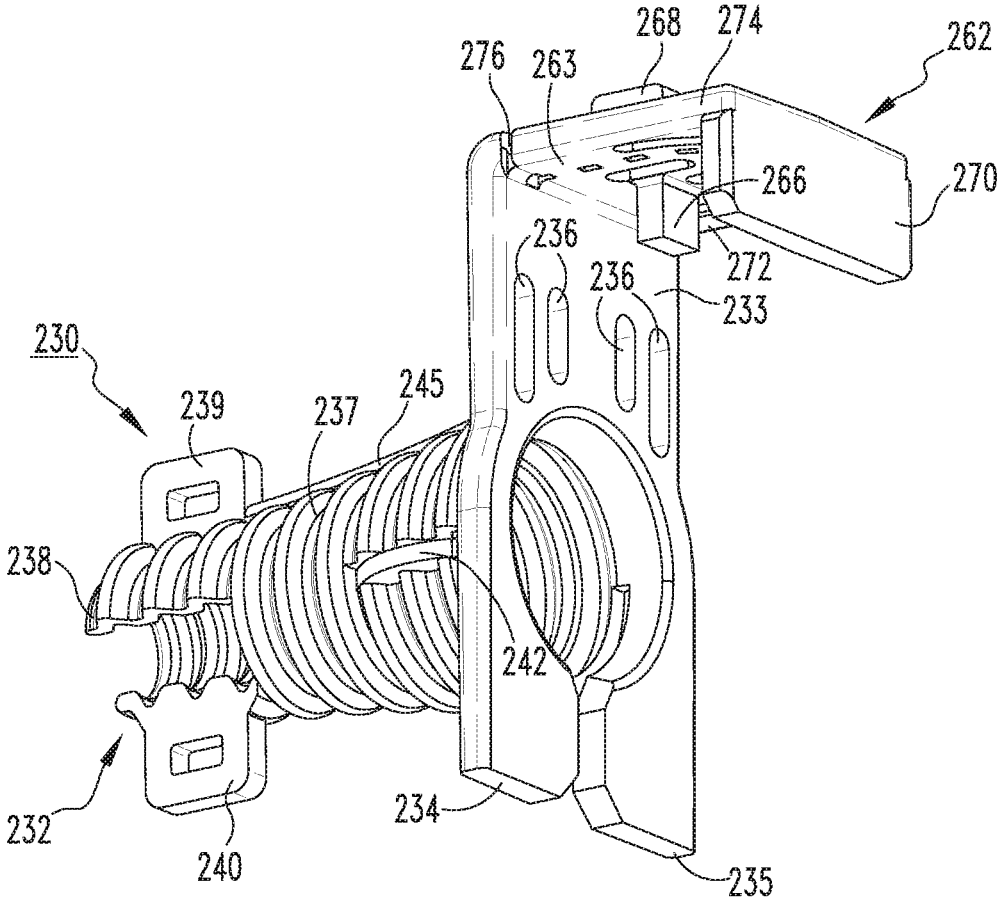
FIG. 6 is an isometric view of a guard member for the electrical system of FIG. 5.

Referring to FIG. 6, the end portions 234,235 of the base portion 233 are spaced apart and are structured to move away from one another in order to receive the wire 204 (FIG. 5) during assembly of the electrical system 200. As such, the guard member 230 is made of suitable flexible insulative material (e.g., without limitation, a flexible rubber material). The base portion 233 and the wall portion 263 also have a corresponding number of thru holes (e.g., without limitation, elongated slots 236,264 (FIG. 5)) that allow for heat to be dissipated from the circuit breaker 202 as well as to allow for exhaustive gases to be vented during circuit interruption. As shown, the receiving portion 232 further includes a tubular portion 237 extending from the base portion 233. In one exemplary embodiment, the tubular portion 237 is corrugated in order to provide beneficial structural support for the guard member 230. The tubular portion 237 has an end portion 238 opposite and distal the base portion 233, and the body of the guard member 230 further includes a number of stiffening portions 242,244 (shown in FIG. 5) extending from the tubular portion 237 longitudinally between the base portion 233 and the end portion 238. The stiffening portions 242,244 provide additional structural support for the guard member 230. In one example embodiment, the body of the guard member 230 further includes a rib portion 245 extending from the base portion 233, the tubular portion 237, and the wall portion 263 in order to provide further structural support for the guard member 230.

Furthermore, the body of the guard member 230 includes a number of ear portions 239,240 each extending outwardly from the tubular portion 237 and having a respective thru hole. The ear portions 239,240 provide a mechanism by which the guard member 230 can be better secured to the wire 204. For example, as shown in FIG. 5, the electrical system 200 further includes a coupling member (e.g., without limitation, wire tie 201, shown in simplified form). The wire tie 201 extends through corresponding thru holes of corresponding ear portions 291,292 of the guard member 290 and is securely tied in order to secure the guard member 290 to the wire 206, which extends through the tubular portion of the guard member 290.

Referring again to FIG. 6, the coupling portion 262 of the guard member 230 further includes a protrusion 266 extending from the wall portion 263, a tab portion 268 extending from proximate the wall portion 263 away from the protrusion 266, and another wall portion 270 extending from and being perpendicular to the wall portion 263. It will be appreciated that the protrusion 266 is structured to partially extend into the terminal screw 214 in order to reliably secure the guard member 230 to the terminal end 208. Additionally, the collar member 212 and the terminal screw 214 are structured to be located between the wall portion 270 and the base portion 233, thereby providing an additional mechanism to secure the guard member 230 to the terminal end 208. Because the guard member 230 is relatively flexible, the tab portion 268 provides a reliable structure for an operator to grasp and be able to remove the guard member 230 from the terminal end 208.

Figure 7:
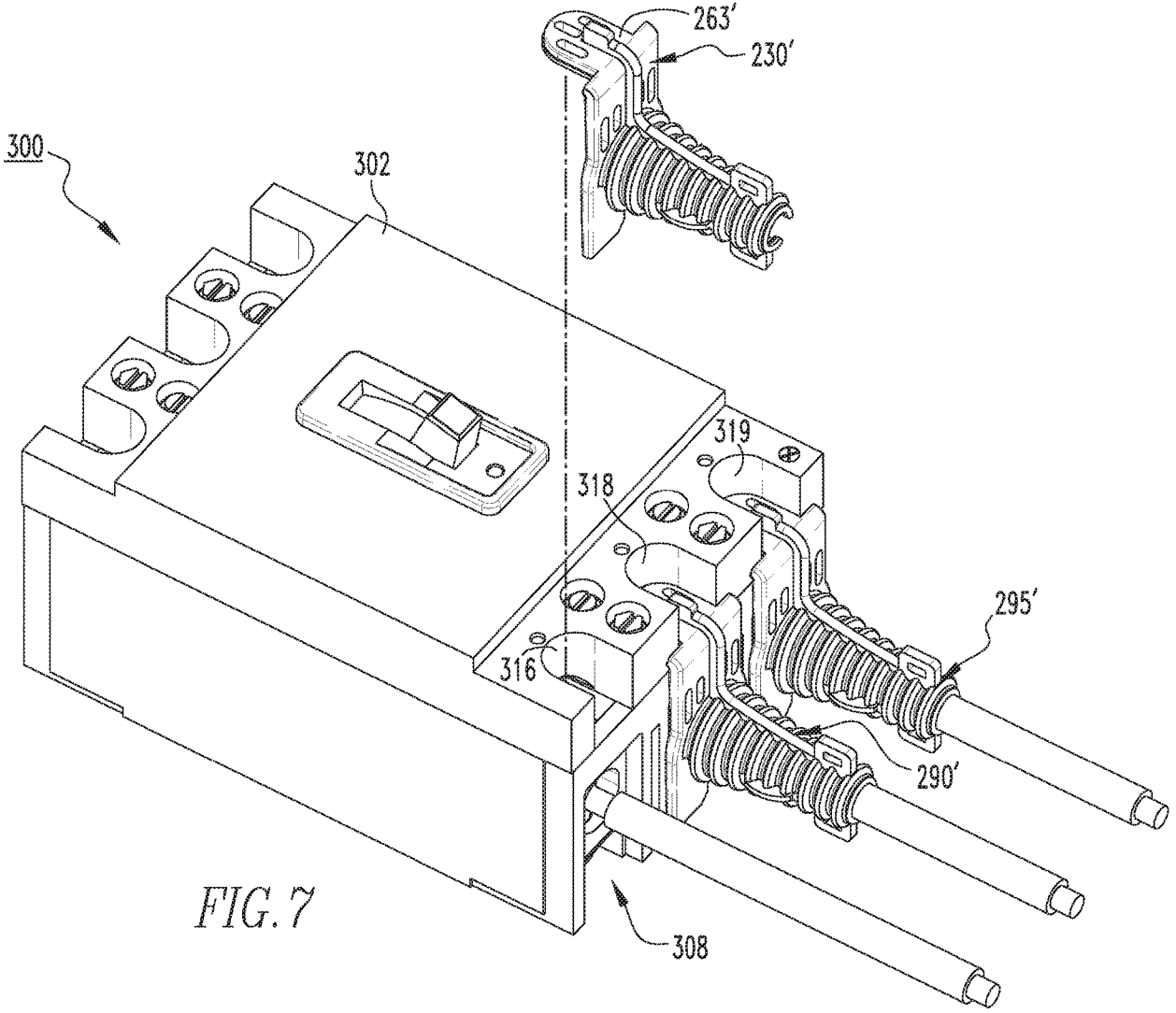
FIG. 7 is a partially exploded isometric view of an electrical system, and electrical switching apparatus and guard member therefor, in accordance with another non-limiting embodiment of the disclosed concept.

Finally, the guard member 230 is versatile in that it is able to employed in other different circuit breakers (e.g., without limitation, circuit breaker 302 of the electrical system 300, shown in FIG. 7). More specifically, the wall portion 263 has spaced apart and parallel edge portions 272,274 that each extend from the base portion 233. As shown in FIG. 5, the wall portion 263 has a thinned portion 276 extending from the first edge portion 272 to the second edge portion 274 and being concave facing toward the base portion 233. The thinned portion 276 has a smaller thickness than other portions of the wall portion 263 and therefore functions as a weakened region. This allow an operator to relatively easily separate (i.e., tear off, remove, detach) a portion (see, for example, portion 278 in FIG. 5) of the wall portion 263.

In comparing the different circuit breakers 202 and 302 shown in FIGS. 5 and 7, respectively, it will be appreciated that the guard member 230, as depicted in FIG. 5, would not be able to be received on the terminal end 308 of the circuit breaker 302. However, the relatively simple removal of the portion 278 of the guard member 230 by way of the thinned portion 276 results in a guard member 230' (FIG. 7) able to be reliably received in the terminal end 308. That is, the housing portion 316 has a profile shaped substantially the same as a periphery of the resulting wall portion 263' of the guard member 230'. See, for example, the engagement between the guard members 290',295' and the respective housing portions 318,319.

EXAMPLE 3

Figure 8:
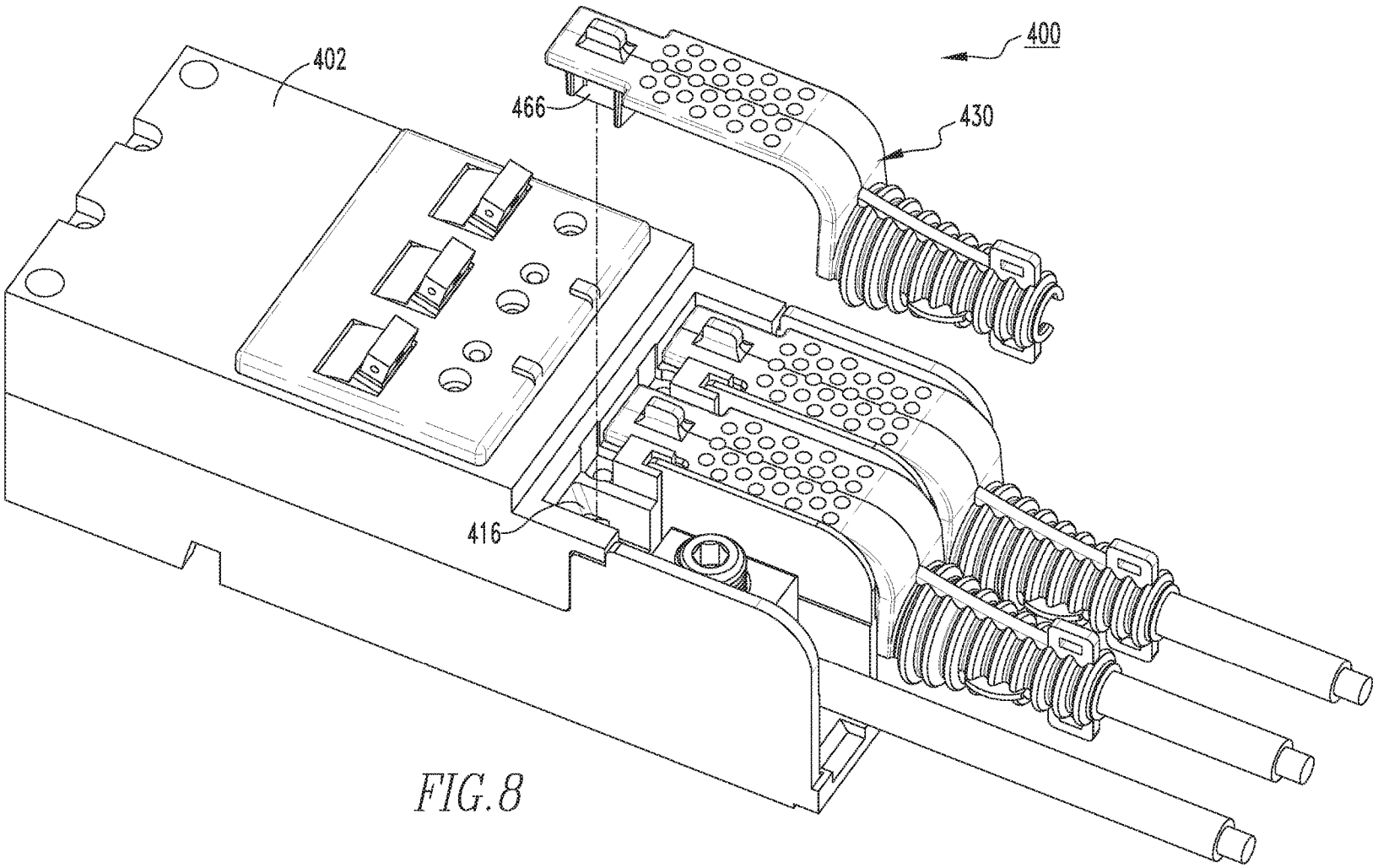
FIG. 8 is a partially exploded isometric view of an electrical system, and electrical switching apparatus and guard member therefor, in accordance with another non-limiting embodiment of the disclosed concept.
Figure 9:
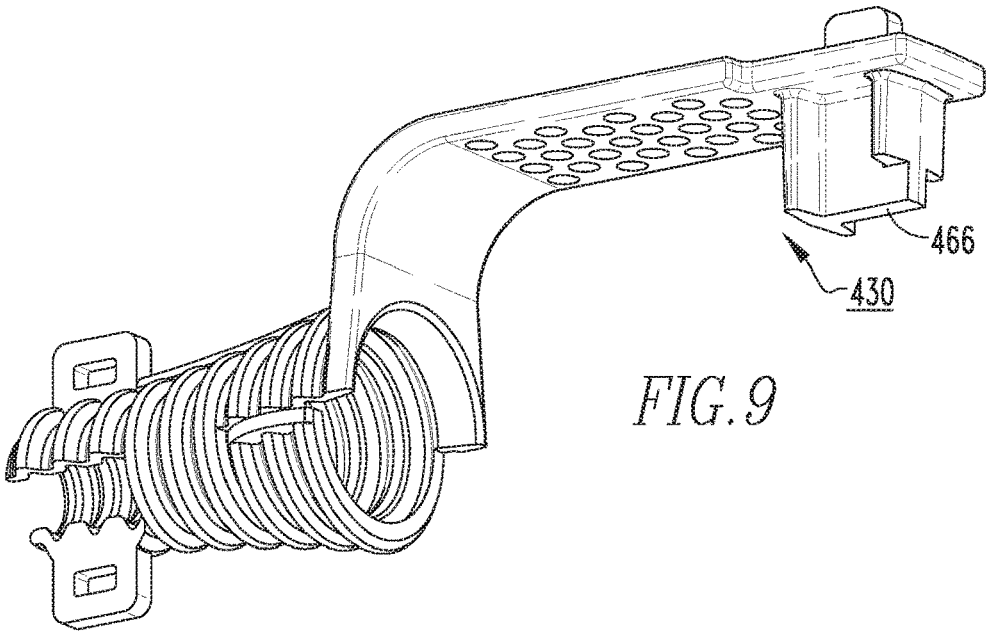
FIG. 9 is an isometric view of a guard member for the electrical system of FIG. 8.

In another example embodiment, the protrusion 466 of the guard member 430 is I-shaped (see, for example, FIG. 9) and is structured to partially extend into the housing portion 416 of the circuit breaker 402 of the electrical system 400, as shown in FIG. 8. It will be appreciated that the housing portion 416 is shaped substantially the same as the protrusion 466 in order to provide a relatively secure engagement between the guard member 430 and the housing portion 416.

EXAMPLE 4

Figure 10:
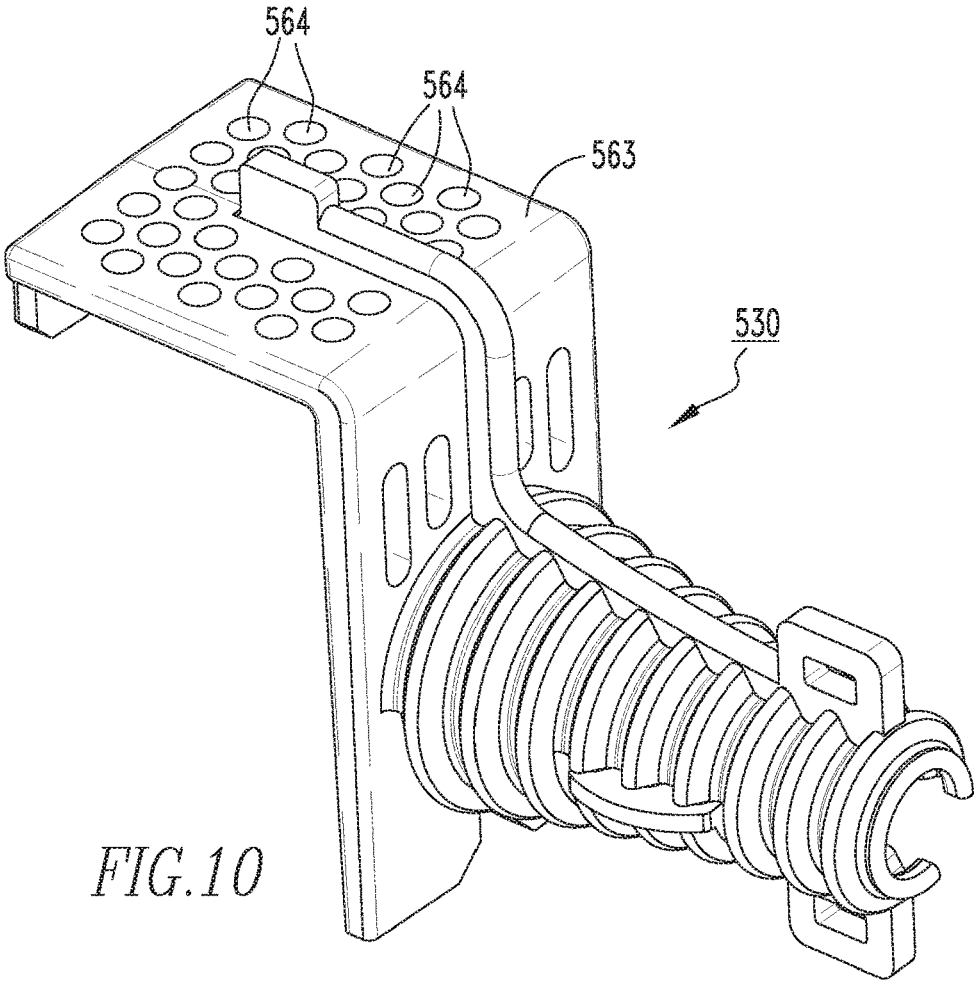
FIG. 10 is an isometric view of a guard member, in accordance with another non-limiting embodiment of the disclosed concept.

In another example embodiment, as shown in FIG. 10, the wall portion 563 of the guard member 530 includes a number of circular-shaped thru holes 564. The thru holes 564 advantageously allow heat to be expelled from the associated circuit breaker (not shown). More specifically, the inventors have discovered that in prior art circuit breakers (not shown), thick insulated housings cause collar members to be on average 2° C. hotter in use than collar members in circuit breakers (not shown) with no such housings. As such, by having the thru holes 564, the guard member 530 allows heat to be expelled while still providing the aforementioned protection against inadvertent contact advantages.

EXAMPLE 5

Figure 11:
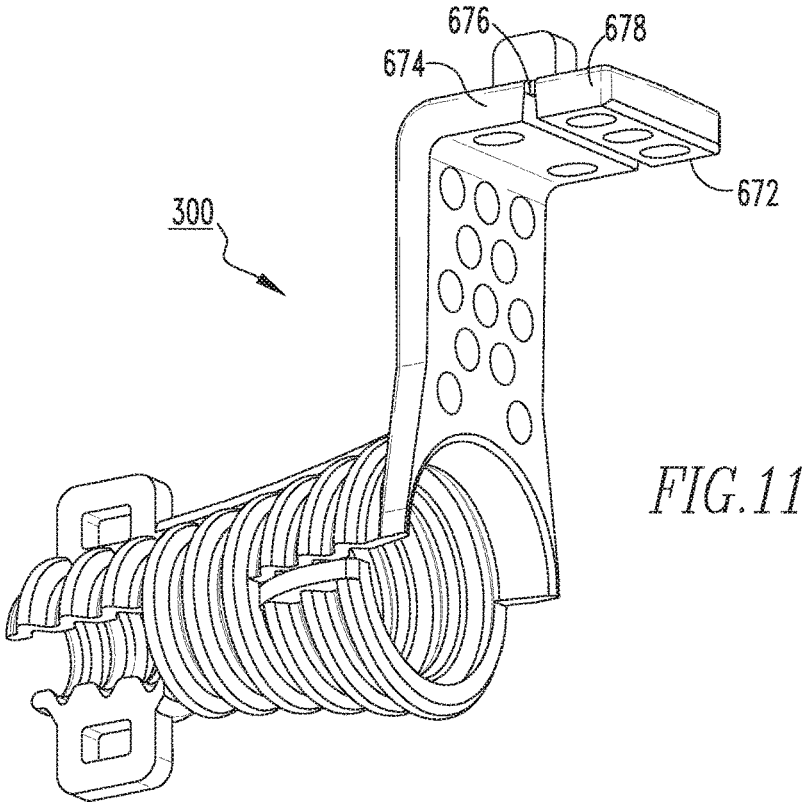
FIG. 11 is an isometric view of a guard member, in accordance with another non-limiting embodiment of the disclosed concept.
Figure 12:
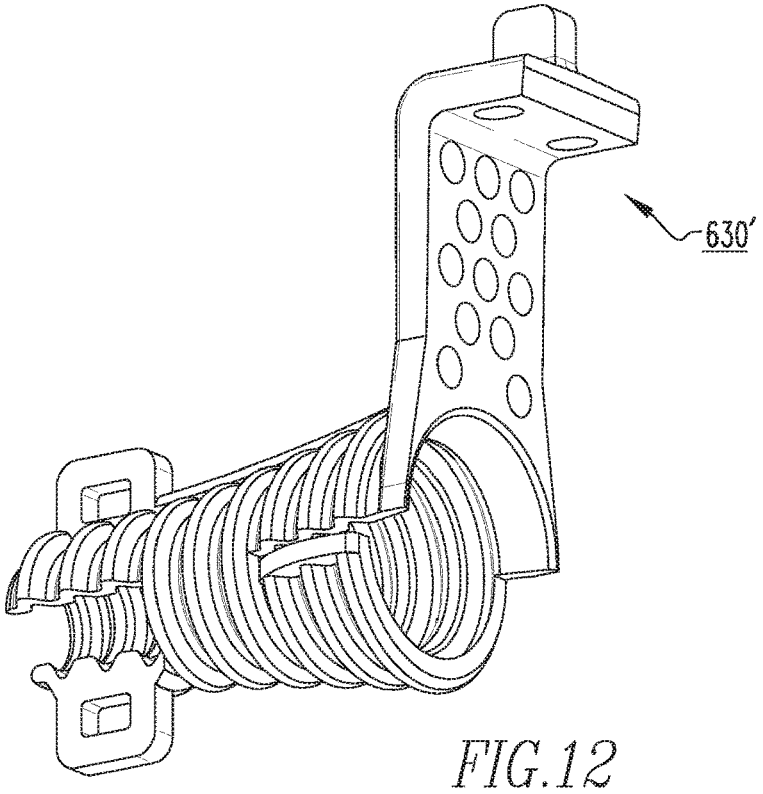
FIG. 12 is an isometric view of the guard member of FIG. 11 shown with a portion removed, in accordance with another non-limiting embodiment of the disclosed concept.

In another example embodiment, as shown in FIG. 11, the thinned portion 676 of the guard member 630 is perpendicular to the edge portions 672,674. As such, while the guard member 630 may be employed with a given circuit breaker (not shown), the relatively simple removal of the portion 678 by way of the thinned portion 676 allows the resulting guard member 630', shown in FIG. 12, to be employed in a different circuit breaker (not shown).

Accordingly, it will be appreciated that the disclosed concept provides for an improved electrical system 100,200, 300,400, and electrical switching apparatus 102,202,302, 402 and guard member 130,190,230,290,295,230',290',295', 430,530,630, 630' therefor, in which operators are protected against inadvertent contact with potentially live electrical components of the electrical systems 100,200,300,400, heat is able to be dissipated, and exhaustive gases are advantageously able to be reliably vented.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical system comprising:

a plurality of electrical conductors; and an electrical switching apparatus structured to move from a CLOSED position to an OPEN position in response to a trip condition, said electrical switching apparatus comprising:

a plurality of terminal ends each coupled to a corresponding one of said electrical conductors, and a plurality of guard members each comprising:

a body comprising:

a receiving portion receiving said corresponding one of said electrical conductors, and a coupling portion extending from said receiving portion and being coupled to a corresponding one of said terminal ends, wherein each corresponding coupling portion has a number of thru holes in order to dissipate heat generated by said electrical switching apparatus moving from the CLOSED position to the OPEN position;

wherein said corresponding coupling portion comprises a wall portion having a plurality of thru holes; wherein said receiving portion comprises a base portion extending from the wall portion; wherein said base portion comprises a first end portion and a second end portion each disposed opposite the wall portion; wherein the first end portion is spaced from the second end portion; wherein said corresponding coupling portion further comprises at least one pair of flexible arms each extending from said wall portion; wherein said at least one pair of flexible arms comprises a first flexible arm and a second flexible arm; wherein said first flexible arm comprises an extension portion and a tab portion; wherein said extension portion extends from said wall portion and is disposed parallel to said second flexible arm; wherein said tab portion extends from said extension portion away from said second flexible arm and is disposed perpendicular to said second flexible arm; wherein said receiving portion further comprises a first side portion, a second side portion opposite and spaced from said first side portion, a first barrier portion extending from said first side portion to said second side portion, a second barrier portion spaced from said first barrier portion, and a number of connecting portions each spaced from one another and extending from said second barrier portion to at least one of said first side portion, said second side portion, and said first barrier portion.

2. An electrical switching apparatus for an electrical system, said electrical system comprising a plurality of electrical conductors, said electrical switching apparatus being structured to move from a CLOSED position to an OPEN position in response to a trip condition, said electrical switching apparatus comprising:

a plurality of terminal ends each coupled to a corresponding one of said electrical conductors; and a plurality of guard members each comprising:

a body comprising:

a receiving portion structured to receive said corresponding one of said electrical conductors, and a coupling portion extending from said receiving portion and being coupled to a corresponding one of said terminal ends, wherein each corresponding coupling portion has a number of thru holes in order to dissipate heat generated by said electrical switching apparatus moving from the CLOSED position to the OPEN position;

wherein said corresponding coupling portion comprises a wall portion having a plurality of thru holes; wherein said receiving portion comprises a base portion extending from the wall portion; wherein said base portion comprises a first end portion and a second end portion each disposed opposite the wall portion; wherein the first end portion is spaced from the second end portion; wherein said corresponding coupling portion further comprises at least one pair of flexible arms each extending from said wall portion; wherein said at least one pair of flexible arms comprises a first flexible arm and a second flexible arm; wherein said first flexible arm comprises an extension portion and a tab portion; wherein said extension portion extends from said wall portion and is disposed parallel to said second flexible arm; wherein said tab portion extends from said extension portion away from said second flexible arm and is disposed perpendicular to said second flexible arm; wherein said receiving portion further comprises a first side portion, a second side portion opposite and spaced from said first side portion, a first barrier portion extending from said first side portion to said second side portion, a second barrier portion spaced from said first barrier portion, and a number of connecting portions each spaced from one another and extending from said second barrier portion to at least one of said first side portion, said second side portion, and said first barrier portion.

3. A guard member for an electrical switching apparatus of an electrical system, said electrical system comprising at least one electrical conductor, said electrical switching apparatus being structured to move from a CLOSED position to an OPEN position in response to a trip condition, said electrical switching apparatus comprising at least one terminal end coupled to said at least one electrical conductor, said guard member comprising:

a body comprising:

a receiving portion structured to receive said at least one electrical conductor, and a coupling portion extending from said receiving portion and being structured to be coupled to said at least one terminal end, wherein said coupling portion and said receiving portion each have a plurality of thru holes in order to dissipate heat generated by said electrical switching apparatus moving from the CLOSED position to the OPEN position;

wherein said coupling portion comprises a wall portion having a plurality of thru holes; wherein said receiving portion comprises a base portion extending from the wall portion; wherein said base portion comprises a first end portion and a second end portion each disposed opposite the wall portion; wherein the first end portion is spaced from the second end portion; wherein said coupling portion further comprises at least one pair of flexible arms each extending from said wall portion; wherein said at least one pair of flexible arms comprises a first flexible arm and a second flexible arm; wherein said first flexible arm comprises an extension portion and a tab portion; wherein said extension portion extends from said wall portion and is disposed parallel to said second flexible arm; wherein said tab portion extends from said extension portion away from said second flexible arm and is disposed perpendicular to said second flexible arm; wherein said receiving portion further comprises a first side portion, a second side portion opposite and spaced from said first side portion, a first barrier portion extending from said first side portion to said second side portion, a second barrier portion spaced from said first barrier portion, and a number of connecting portions each spaced from one another and extending from said second barrier portion to at least one of said first side portion, said second side portion, and said first barrier portion.

4. The guard member of claim 3 wherein said receiving portion further comprises a support portion extending from said first side portion to said second side portion; and wherein said support portion has a first thinned portion extending from said first side portion and a second thinned portion extending from said second side portion.

* * * * *